United States Patent [19]

Larson

[11] 4,320,573

[45] Mar. 23, 1982

[54] METHOD OF MANUFACTURE FOR BENDABLE MEMBRANE SWITCH

[75] Inventor: Willis A. Larson, Crystal Lake, Ill.

[73] Assignee: Oak Industries Inc., Rancho Bernardo, Calif.

[21] Appl. No.: 154,913

[22] Filed: May 30, 1980

[51] Int. Cl.[3] ..... H01H 11/00

[52] U.S. Cl. ..... 29/622; 200/5 A; 200/159 B

[58] Field of Search ..... 29/622; 200/5 A, 159 B, 200/153 H, 85 R, 61.7, DIG. 35

[56] References Cited

U.S. PATENT DOCUMENTS

| | | | |
|---|---|---|---|
| 3,722,086 | 3/1973 | Wikkerik | 29/622 |
| 4,034,176 | 7/1977 | Larson | 200/159 B |
| 4,065,649 | 12/1977 | Carter et al. | 200/159 B |
| 4,180,711 | 12/1979 | Hirata | 200/159 B X |
| 4,249,054 | 2/1981 | Komaki | 200/159 B |

*Primary Examiner*—Leon Gilden

*Attorney, Agent, or Firm*—Kinzer, Plyer, Dorn & McEachran

[57] ABSTRACT

A membrane switch of the type actuated by bending is manufactured from a blank of flexible sheet material. An appropriate pattern of conductors is silk-screened on first and second portions of the blank. Then an insulative spacing means is silk-screened onto the first and second portions in a symmetrical pattern. Adhesive is applied to the blank. Hinges are formed along the line of symmetry of the spacing means and the second portion of the blank is folded over the first portion along these hinges to complete the switch. The adhesive holds the folded switch together with the first portion of the blank forming the switch substrate and the second portion forming the membrane.

7 Claims, 5 Drawing Figures

METHOD OF MANUFACTURE FOR BENDABLE MEMBRANE SWITCH

SUMMARY OF THE INVENTION

This invention relates to membrane switches and in particular to switches of the type which are able to accomodate over travel of an actuating member. The switch is mounted in cantilevered fashion on a base. The switch is actuated by bending the cantilever portion of the switch. A slight degree of bend will cause the switch to close with over travel being taken up by an increased angle of bending. When the actuating force is released the switch returns to its normal, flat position.

A primary object of the present invention is the economical manufacture of membrane switches actuated by bending.

Another object of the present invention is to manufacture a membrane switch actuated by bending using a minimal amount of conductive material.

Another object is a method of manufacturing a membrane switch actuated by bending wherein the switch is formed from a single piece of sheet material.

Another object is a method of manufacture of a membrane switch of the type described which insures accurate alignment of switch components.

Other objects will appear in the ensuing specification, drawings and claims.

DESCRIPTION OF A PREFERRED EMBODIMENT

This invention relates to membrane switches, and more specifically, to a particular type which permits over travel of an actuating member. A membrane switch of the type described generally includes a substrate with electrical conductors formed thereon and a flexible membrane also having a suitable pattern of conductors on it. The conductors are held apart in non-contacting, spaced relation by an insulative spacing means. The spacing means has suitable holes or openings through which the conductors on the membrane can move into contact with those on the substrate to close the switch.

Typically such switches are made from thin sheets of flexible material, for example Mylar. This material is on the order of 0.005 inches thick. The spacing means will usually have a similar or lesser thickness. Thus it can be seen that the stroke length available for an actuating member for such a switch is very small. In some applications it is desirable to allow the actuating member to continue to move even after the switch has been closed. A switch underneath a key of an electronic organ is an example of such an application. One way to accomplish this is to allow both the membrane and substrate to move in response to the forces of an actuating member. Such a switch may be mounted on a base in a cantilever fashion. The actuating member bends the cantilevered portion of the switch over the edge of the base. The switch closes upon the start of bending and then remains closed as further bending takes place. The switch returns to its normal, cantilevered position when the actuating force is removed.

Figure 1:
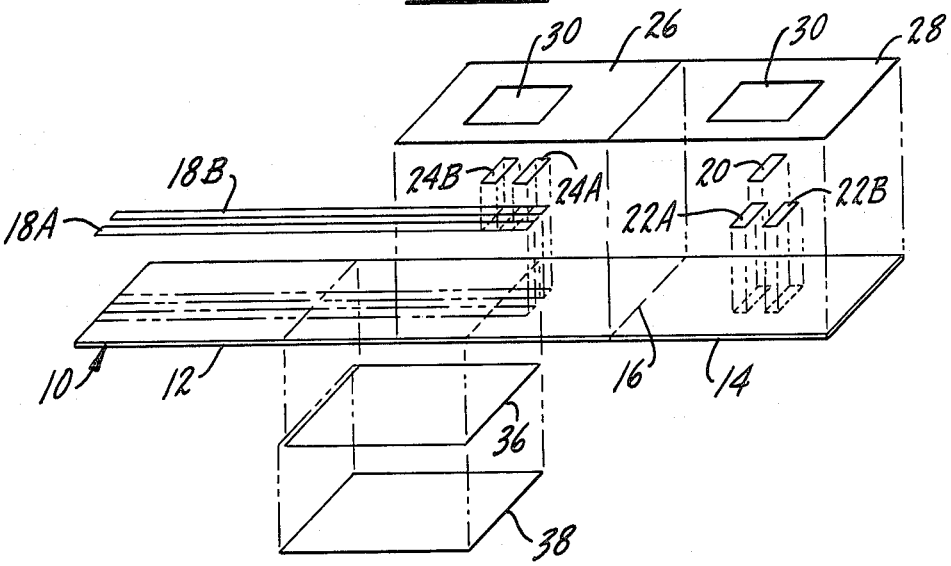
FIG. 1 is an exploded, perspective view showing the steps for preparation of a membrane switch according to the present invention.
Figure 2:
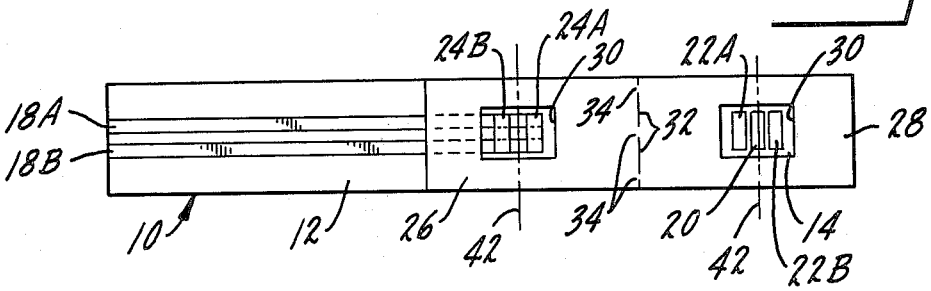
FIG. 2 is a top plan view of a membrane switch prior to folding the membrane portion over the substrate portion.
Figure 3:
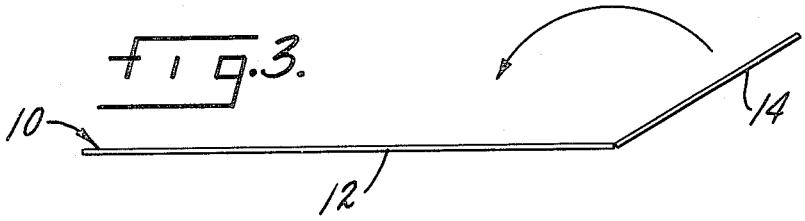
FIG. 3 is a side elevation view showing the folding operation which completes the switch.

The present invention is concerned with an improved method of manufacturing a switch of the type described. Reference will be made to FIGS. 1–3 for describing this method. The switch is formed on a piece of flexible, sheet material. In the illustrated embodiment this takes the form of an elongated, generally rectangular blank 10. The blank 10 will be described as having a first portion 12 and a second portion 14, separated by a line of symmetry 16. The significance of the line of symmetry 16 will be described below. It will be understood that other forms of the sheet material could be used. For example, instead of the precut individual switch blank shown, there could be a plurality of switches formed on a large piece of sheet material which is later cut into individual switches. Or a plurality of switches could be formed on a single piece of sheet material which is later partially cut to form individual switches attached to a common base.

Once the blank 10 is prepared, in whatever form, a first conductor is applied to the first portion 12 of the blank. In a preferred embodiment, the first conductor includes two spaced electrodes 18A and 18B. Electrodes 18A and 18B extend along the length of the blank 10, preferably parallel to one another and the sides of the blank. A second conductor is also applied to the second portion 14 of the blank. The second conductor includes a single electrode or shorting bar 20. The electrode 20 extends laterally to the electrodes 18A and 18B of the first conductor. Also, the electrode 20 is applied to that portion of the blank which will eventually define the line of bending for this switch. Both the first and second conductors are applied in liquid form, either silk-screening or painting. Obviously, an electrically-conductive paint which is flexible when dried is used. The first and second conductors are applied all in one pass and then dried.

The next operation is to silk-screen or paint an insulative spacing means on the blank. The spacing means is in the form of a pair of spacer bars 22A and 22B, one on either side of the second conductor shorting bar 20. These spacer bars have a thickness of approximately 0.001–0.004 inches. This is approximately the same thickness as the electrode or shorting bar 20. The spacing means also includes a second pair of spacer bars 24A and 24B which are located on the first portion 12 of the blank 10. The spacer bars 24A and 24B are located so as to make the entire spacing means symmetrical about the line of symmetry 16. That is, the spacer bars 22A and 24A are equally distant from the line of symmetry 16, as are the spacer bars 22B and 24B. Both pairs of spacer bars are applied in liquid form in a manner similar to that of the first and second conductors. The spacers are applied in the same pass and then dried.

After the spacing means has been formed, an adhesive is applied to the blank. This is shown as a pair of rectangular layers 26 and 28. The layer 26 is applied to the first portion 12 of the blank while the layer 28 is applied to the second portion 14. Each layer has a rectangular opening 30 which leaves the spacing means and first and second conductors exposed as best seen in FIG. 2. The adhesive material is a thermo-plastic dry film adhesive which is silk-screenable. On drying, it is non-tacky and does not stick to other materials. The adhesive is activated when the assembled switch is run through a heated nip-roller. In some applications it may not be necessary to apply adhesive layers to both the first and second portions of the blank. Thus it may be possible to use only one layer either on the first or second portion.

After the application of the adhesive the switch is prepared for assembly by forming hinges along the line of symmetry 16. This is done by die-cutting slots as at 32 with small uncut portions between the slots. These uncut portions form hinges 34. The hinge configuration is formed by rule die-cutting. After the rule is mounted it is knicked by a sharp blade to provide one or more dents in the cutting edge. Typically, these dents are 0.010 inches wide. The rule die then does not cut at the knicked points and thus provides the hinges 34.

The switch is assembled by folding the second portion 14 of the blank over the first portion 12 in a manner illustrated in FIG. 3. The fold is made along the line where the hinges are formed which is also the line of symmetry. The adhesive holds the two portions together so that the second portion 14 forms the membrane and the first portion forms the substrate of the switch. The spacer bars 22A and 24A are aligned as are the bars 22B and 24B.

It may also be desirable to place an adhesive layer 36 on the underside of the blank together with a release liner 38. This adhesive layer may be used to attach the completed switch to a base or support member.

Figure 4:
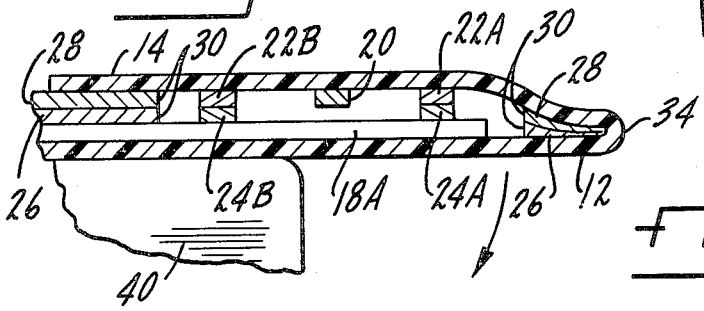
FIG. 4 is an enlarged, side elevation view in section showing a completed switch according to the present invention mounted on a base.
Figure 5:
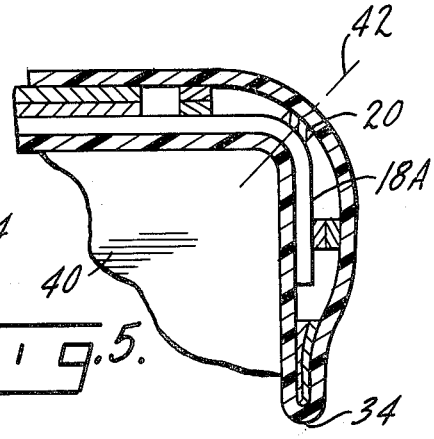
FIG. 5 is a side elevation view in section of a membrane switch in an actuated position. The separation of the switch layers is exaggerated in FIGS. 4 and 5 to show the intervening elements more clearly.

FIGS. 4 and 5 illustrate the operation of a switch mnaufactured in accordance with the present invention. The switch is mounted on a base or support member 40 in a cantilever fashion. In the unactuated position of FIG. 4 the shorting bar 20 of the second conductor is located above and spaced from the electrodes of the first conductor. When an actuating force is applied, the switch bends around the edge of the base 40. As the switch starts to bend the shorting bar 20 moves into contact with the electrodes 18A and 18B, providing an electrical connection between those two electrodes. Further travel of the actuating member can be accommodated by a greater degree of bending in the switch. When the actuating force is removed the switch returns to the position shown in FIG. 4.

It can be seen that the shorting bar 20 is formed along the line of bending. This is illustrated in FIG. 2 where the line of bending is represented by line 42. Of course in FIG. 2 there are two lines of bending 42 before the switch is folded. These lines will coincide after final assembly of the switch. Formation of the electrode 20 along the line of bending permits the use of a very narrow shorting bar while still assuring that contact will be made when the switch is actuated. This minimizes the use of expensive conductor material.

Another advantage of the present invention is that is utilizes a one-piece switch construction. This simplifies alignment of switch parts by eliminating the need to locate one piece relative to another. Instead, the alignment is inherent in the location of the conductors, spacing means and hinges. The problem of accurately locating these parts is relatively minor compared to the difficulties of aligning separate pieces for the membrane, substrate and spacer.

Whereas a preferred form of the present invention has been shown and described, it will be realized that there may be many substitutions, alterations and modifications made thereto.

I claim:

1. In a membrane switch of the type mounted on a base in cantilevered fashion and actuated by bending the cantilevered end of the switch along a line of bending, an improved method of manufacturing said switch, comprising the steps of:

(a) preparing an elongated, generally rectangular blank of flexible sheet material;

(b) applying to a first portion of said blank, a first conductor including two spaced electrodes extending along the length of said blank, and applying to a second portion of said blank, a second conductor including a single electrode extending laterally to the first conductor and along the line of bending, both the first and second conductors being applied in liquid form to the same side of the blank;

(c) applying to said blank, an insulative spacing means including a pair of spacer bars, one on either side of the second conductor, and another pair of spacer bars arranged on the first portion of the blank so as to make the spacing means symmetrical about a line dividing the first and second portions of the blank, both pairs of spacer bars being applied in liquid form to the same side of the blank;

(d) applying adhesive to the blank;

(e) folding the second portion of the blank over the first portion such that the spacer bars are aligned, with the adhesive holding the portions together.

2. The method of claim 1 further including the step of forming hinges along said line dividing the first and second portions of the blank, the hinges being formed by cutting slots in the sheet material prior to the folding step.

3. The method of claim 2 further characterized in that the hinges are formed by die cutting the slots.

4. The method of claim 1 further including the step of applying adhesive to the side of the blank opposite the one on which the conductors are formed, said adhesive being effective for mounting the switch on the base.

5. The method of claim 1 further characterized in that the conductors and spacing means are applied by silk-screening.

6. The method of claim 1 further characterized in that the adhesive is applied by silk-screening.

7. The method of claim 1 further characterized in that the adhesive is applied to both the first and second portions of said blank.

* * * * *